US006775955B1

(12) United States Patent
Smith et al.

(10) Patent No.: US 6,775,955 B1
(45) Date of Patent: Aug. 17, 2004

(54) METHOD OF PACKAGING AN OBJECT

(76) Inventors: Charles J. Smith, 4521 290th St., Toledo, OH (US) 43611; Thomas J. Nachtman, 1407 Hampshire Rd., Temperance, MI (US) 48182

( * ) Notice: Subject to any disclaimer, the term of this patent is extended or adjusted under 35 U.S.C. 154(b) by 0 days.

(21) Appl. No.: 10/299,877

(22) Filed: Nov. 19, 2002

(51) Int. Cl.[7] ..... B65B 61/00; G21F 9/00; B05D 1/02

(52) U.S. Cl. ..... 53/141; 53/396; 53/140; 53/442; 53/557; 588/2; 588/6; 588/16; 527/421

(58) Field of Search ..... 53/396, 140, 141, 53/442, 557; 588/2, 6, 16, 200; 427/5, 6, 421

(56) References Cited

U.S. PATENT DOCUMENTS

| | | | | | |
|---|---|---|---|---|---|
| 3,440,086 | A | * | 4/1969 | Kern | 427/373 |
| 3,589,102 | A | * | 6/1971 | Zelnick | 53/557 |
| 3,641,732 | A | * | 2/1972 | Fujio | 53/412 |
| 4,396,729 | A | | 8/1983 | Dominquez et al. | 521/51 |
| 4,433,067 | A | | 2/1984 | Rice et al. | 521/51 |
| 4,444,910 | A | | 4/1984 | Rice et al. | 521/51 |
| 4,607,090 | A | | 8/1986 | Dominguez | 528/48 |
| 4,716,210 | A | * | 12/1987 | Trummelmeyer et al. | 528/75 |
| 4,783,295 | A | * | 11/1988 | Kearns et al. | 264/50 |
| 5,013,508 | A | * | 5/1991 | Troester | 264/224 |
| 5,013,813 | A | | 5/1991 | Zimmerman et al. | 528/60 |
| 5,050,738 | A | * | 9/1991 | McAdams | 206/497 |
| 5,124,426 | A | | 6/1992 | Primeaux, II et al. | 528/60 |
| 5,171,818 | A | * | 12/1992 | Wilson | 528/59 |
| 5,189,075 | A | | 2/1993 | Zimmerman et al. | 521/159 |
| 5,415,499 | A | | 5/1995 | Hyde-Smith et al. | 405/303 |
| 5,763,734 | A | | 6/1998 | Nachtman et al. | 388/1 |
| 6,189,635 | B1 | * | 2/2001 | Schuler et al. | 180/68.5 |
| 6,635,893 | B2 | * | 10/2003 | O'Kane et al. | 250/506.1 |

OTHER PUBLICATIONS

Anon, Shrinkwrap a Big Saver for Big Loads, Apr. 1989, Pira International, vol. 43, No. 4, p. 35.*

* cited by examiner

*Primary Examiner*—Scott A. Smith
*Assistant Examiner*—Brian Nash
(74) *Attorney, Agent, or Firm*—MacMillan, Sobanski & Todd, LLC

(57) ABSTRACT

This invention relates to a method of strong/tight packaging an object in order to prepare it for shipping. Initially, a substrate is applied to an object to create a smooth surface adapted to receive a sprayable plastic thereon. Then, the sprayable plastic is sprayed onto the substrate and the object to encapsulate the object.

18 Claims, 4 Drawing Sheets

METHOD OF PACKAGING AN OBJECT

BACKGROUND OF THE INVENTION

This invention relates in general to methods of packaging large objects for shipping. More particularly, the invention relates to a method of creating a strong/tight package for a large contaminated object so that it can be shipped safely.

The end of the Cold War has resulted in a need to shut down and decontaminate nuclear arms manufacturing sites. The decontamination process includes removing objects from the sites that are contaminated with low or high level radiation. Many objects can be removed by loading them into cargo containers, and shipping the cargo containers for storage in an underground nuclear storage site. However, some objects are too large to fit into the cargo containers. Such objects include, for example, large machining equipment and tools, plutonium furnaces, supercompactors and the like. In order to fit the objects into the cargo containers, the objects would have to be cut into pieces with a plasma cutter or similar device. The cutting operation would be time-consuming and costly, and it could allow the release of contaminants into the atmosphere.

Alternatively, a large contaminated object can be shipped by loading it on a high-strength oversized pallet, and covering the pallet and the object with a large lid known as a "butter dish". Unfortunately, the pallet and the butter dish are relatively expensive. Also, the cost of storing the object inside the butter dish at the storage site is relatively high, because storage costs are charged based on all the volume inside the dish even though the object does not completely fill the dish. Another disadvantage is that shipping the object inside the butter dish may be hazardous because there is a risk the object could tip over during shipping and break through the dish. Additionally, some objects are too large to be shipped by this method.

SUMMARY OF THE INVENTION

This invention relates to a method of strong/tight packaging an object in order to prepare it for shipping. By "shipping", as used herein, is meant any type of transportation such as truck, railroad, air transportation or water transportation. Initially, a substrate is applied to an object to create a smooth surface adapted to receive a sprayable plastic thereon. Then, the sprayable plastic is sprayed onto the substrate and the object to encapsulate the object.

In a particular embodiment of the method, a sprayable plastic is first sprayed onto a surface of a pallet to create a continuous first layer of the plastic on the surface. An object is positioned on the first layer of plastic on the pallet. The first layer of plastic has an outline that is at least as large as the outline of the object on the pallet. A substrate is applied to the object to create a smooth surface adapted to receive a second layer of the sprayable plastic thereon. Lastly, the second layer of sprayable plastic is sprayed onto the substrate to encapsulate the object.

DETAILED DESCRIPTION OF THE PREFERRED EMBODIMENTS

Figure 1:
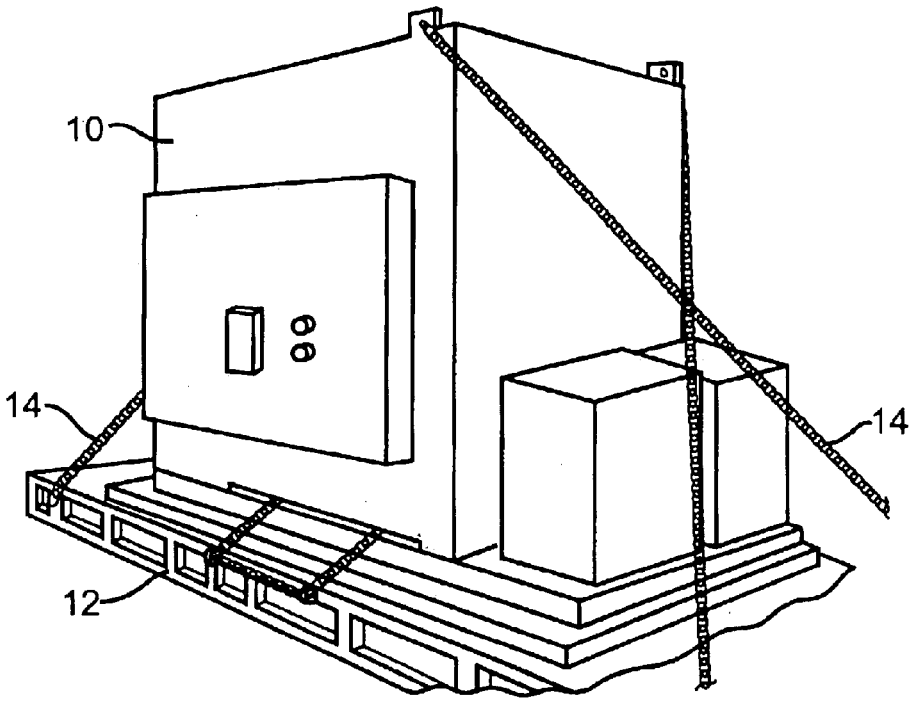
FIG. 1 is a perspective view of a large contaminated object on a pallet.

The invention relates to a method of strong/tight packaging an object in order to prepare it for shipping. The method can be used with any type of object, but typically the object is contaminated with some type of contamination or hazardous material, such as beryllium, asbestos, different types of radiation such as uranium or plutonium, biohazardous materials, or toxic materials. The object is usually too large to fit into a cargo containers; typically the object has a volume of at least about 100 $ft^3$, often at least about 300 $ft^3$, and sometimes at least about 500 $ft^3$. The object typically weighs at least about 1000 pounds, commonly at least about 2 tons, and sometimes at least about 5 tons. For example, a large machine tool may weigh about 12 tons.

Initially, a substrate is applied to the object to create a smooth surface adapted to receive a sprayable plastic thereon. The object usually has an irregular configuration, such as a configuration including one or more recesses, gaps, irregular surfaces or other irregularities that do not provide a good surface for spraying a continuous layer of plastic. Applying the smooth substrate to the object before spraying the plastic provides a surface that allows the plastic to form a continuous layer that encapsulates the object. Also, the substrate preferably covers the object so that the spraying process does not cause contaminants to blow out from the object. The sprayed plastic usually adheres to the substrate, but such is not necessary so long as the substrate provides a suitable surface for spraying on. The substrate can be any type of suitable material, such as plastic, cloth, tarp, netting, needle punched felt, or geotextile. Preferably, the substrate is a sheet material, and more preferably a plastic sheet. In some embodiments, the substrate is a polyester sheet material (e.g., like that used to make trash bags) or a shrink wrap plastic material. It is sometimes preferred to shrink wrap the substrate about the object; in such cases, a suitable shrink wrap plastic material is wrapped about the object and heat is applied to shrink the material. Typically, the object is positioned on a pallet, a shrink wrap plastic sheet material is wrapped about the object and fastened to the pallet with staples or other suitable fasteners, and the material is heated to shrink it with a heat cannon or other suitable heating device. A vacuum can optionally be added to suck down the shrink wrap or plastic. Alternatively, the substrate can be sized to fit closely over the object so that shrink wrapping is not needed.

The substrate is usually applied to completely cover the exposed surfaces of the object (i.e., if the object is positioned on a pallet, the substrate covers all the surfaces except those adjacent to the pallet). However, if the object has surface portions that are adapted for receiving the sprayable plastic thereon without being covered, it is not necessary to cover those portions of the object.

After the substrate has been applied to the object, the sprayable plastic is sprayed onto the substrate and the object to encapsulate the object. Preferably, the plastic forms a continuous skin that totally encapsulates the object. If the object is positioned on a pallet, the plastic usually covers at least all of the object except that adjacent to the pallet. In such a case, the plastic may also extend onto a portion of the pallet to completely seal off the object from the surrounding atmosphere. The sprayable plastic is usually a fluid when sprayed, and it cures to form an encapsulating plastic layer. Preferably, the plastic creates a water-proof encapsulation about the object to avoid any leaks of contaminated water (e.g, from rain entering the plastic and leaking out with contaminants). Also preferably, the plastic creates a tough skin that is impervious to all conditions encountered during transportation of the object (e.g., various environmental conditions, and air buffeting the object as it is transported at high speed on a highway). In some embodiments, it is preferred to have a strong and rigid plastic layer, and in other embodiments it is preferred to have a strong yet flexible layer. The plastic layer can have any suitable thickness, preferably a thickness of from about ⅛ inch to about ½ inch, and typically from about ⅛ inch to about 3/16 inch. The plastic layer can have any suitable density; a typical density of a 3/16 inch thick layer is about 0.8 lbs./ft.$^2$ Preferably, the sprayable plastic is moderate in cost. Optionally, a hepa filter device can be positioned in the plastic layer so that it can breathe to release pressure at high altitudes.

Figure 2:
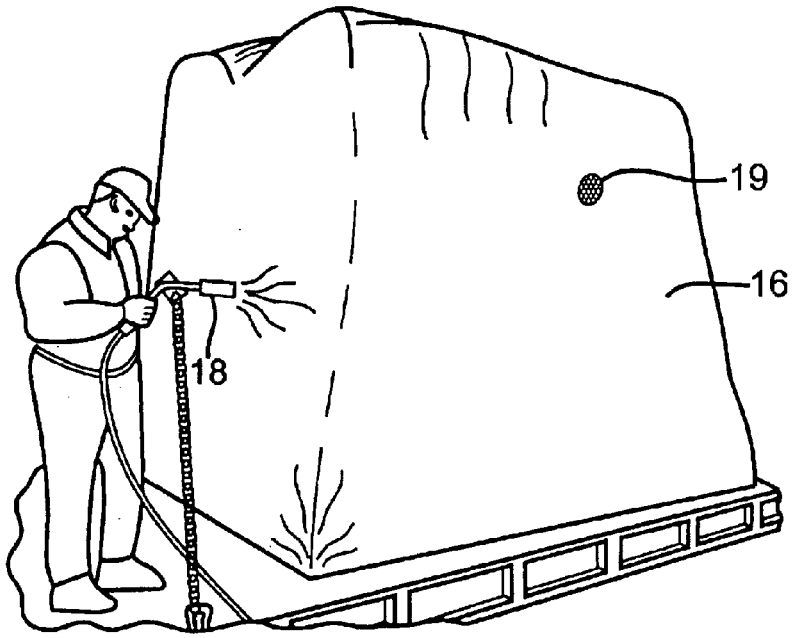
FIG. 2 is a perspective view of a worker applying heat to a sheet substrate that has been wrapped around the object, in order to shrink wrap the object with the substrate.
Figure 3:
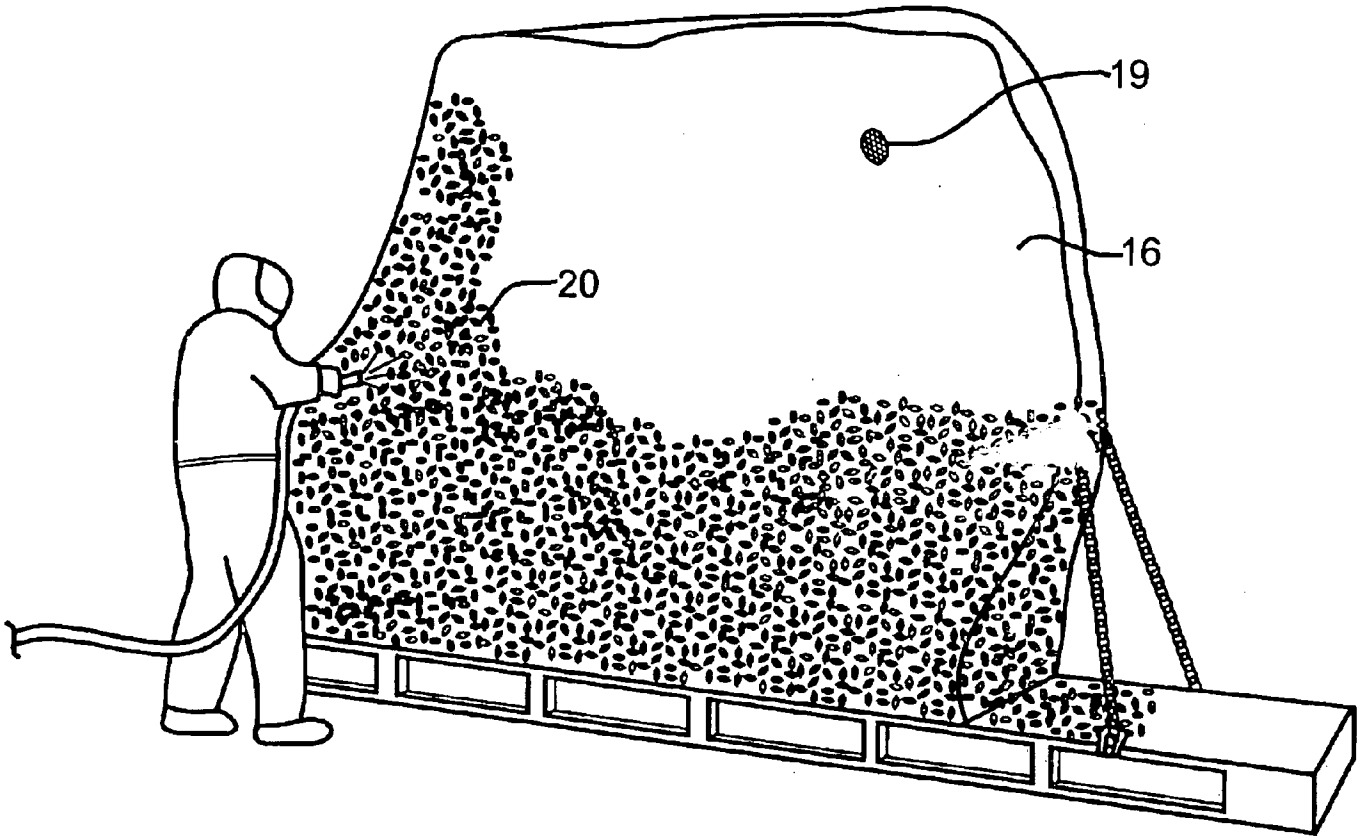
FIG. 3 is a perspective view of a worker spraying a sprayable plastic onto the substrate and the object to encapsulate the object.

FIGS. 1–4 illustrate one embodiment of the method of the invention. As shown in FIG. 1, a large contaminated object 10 is positioned on a pallet 12 and secured thereto with chains 14. As shown in FIG. 2, a plastic sheet substrate 16 has been wrapped around the object, and a worker is applying heat to the substrate with a heat cannon 18 to shrink wrap the substrate about the object. The bottom perimeter of the substrate can be bonded to the pallet with tape, tacks, or any other suitable fastening means (not shown). A hepa filter device 19 is optionally positioned in the sheet substrate. As shown in FIG. 3, the worker is spraying a sprayable plastic 20 onto the substrate 16 and the object to encapsulate the object. The spraying is continued (not shown) until the object 10 is completely covered with the sheet substrate 16 and a layer of the sprayed plastic 20.

To facilitate encapsulation of the object, it is sometimes preferred to spray the plastic onto a surface of the pallet and let it cure to create a continuous layer on the surface, before positioning the object on the pallet. The term "pallet" as used herein means any type of base upon which the object is positioned for shipping. In some situations, it is preferred to apply a substrate to the surface of the pallet before spraying the plastic on the surface. This is usually the case when the pallet is relatively porous, such as when it is made of wood and/or when there are spaces between slats on the surface the pallet. The substrate can optionally be attached to the substrate by any suitable fastening means (not shown), such as tape, adhesive, nails or tacks.

Figure 4A:
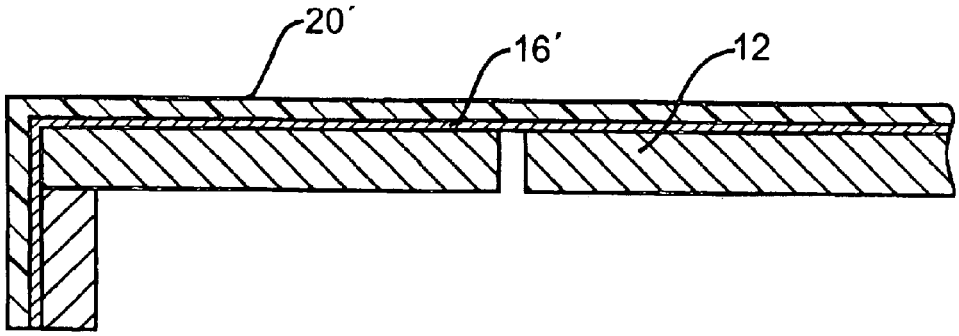
FIGS. 4*a*–4*d* are cross-sectional views of a pallet and an object showing in more detail the steps for strong/tight packaging the object for shipping according to one embodiment of the invention.
Figure 4B:
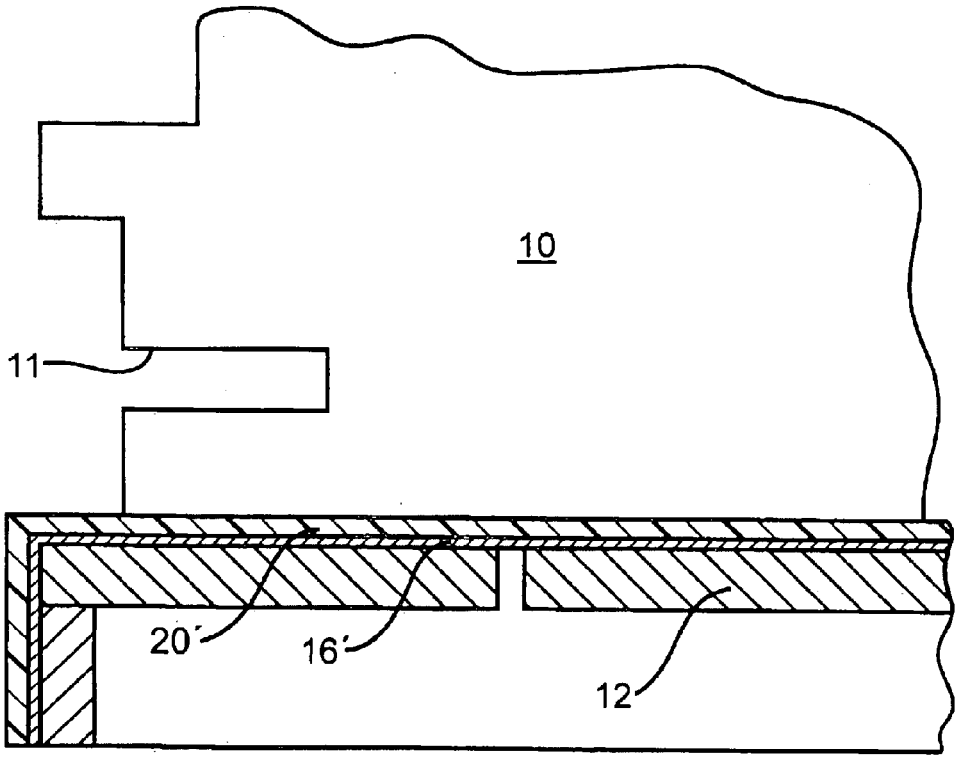

FIG. 4*a* shows a pallet 12 covered with a substrate 16' and sprayed with a first layer of sprayable plastic 20'. As shown in FIG. 4*b*, after the sprayed plastic cures, the object 10 is positioned on the plastic layer on the pallet. The illustrated object 10 has an irregular configuration 11. Preferably, the first layer of plastic is sprayed on such that it has an outline that is at least as large as the outline of the object on the pallet. In the embodiment shown in FIGS. 4*a* and 4*b*, the first layer of plastic 20' extends across the top and over the side of the pallet 12.

Figure 4C:
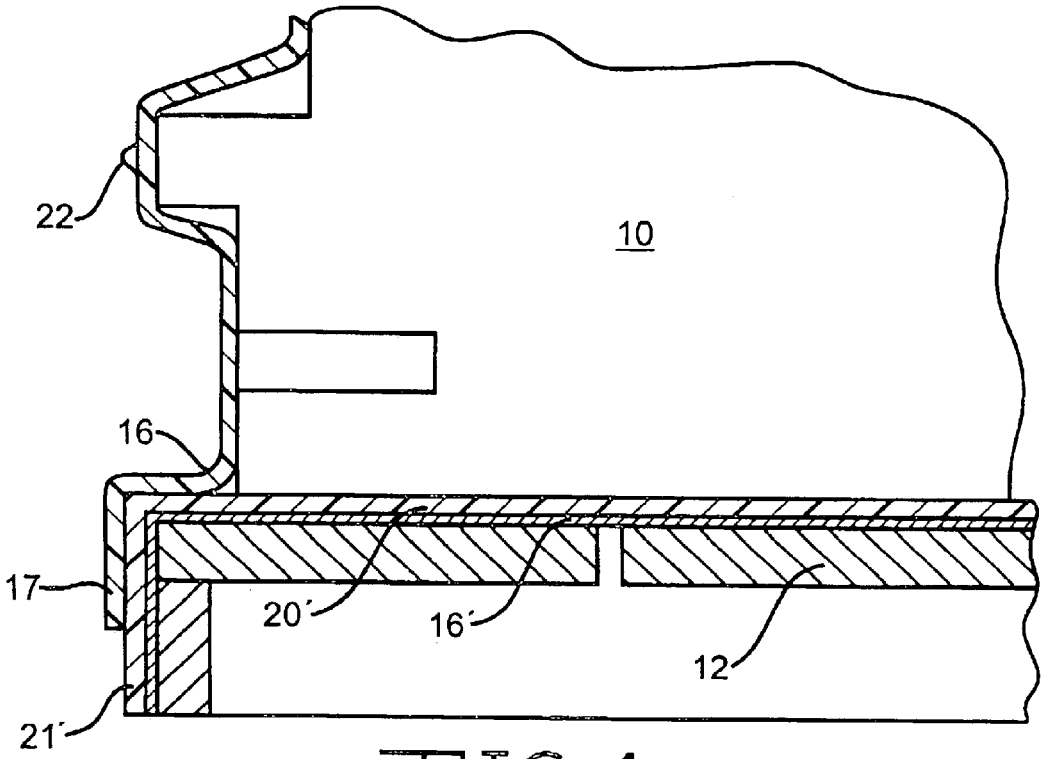
Figure 4D:
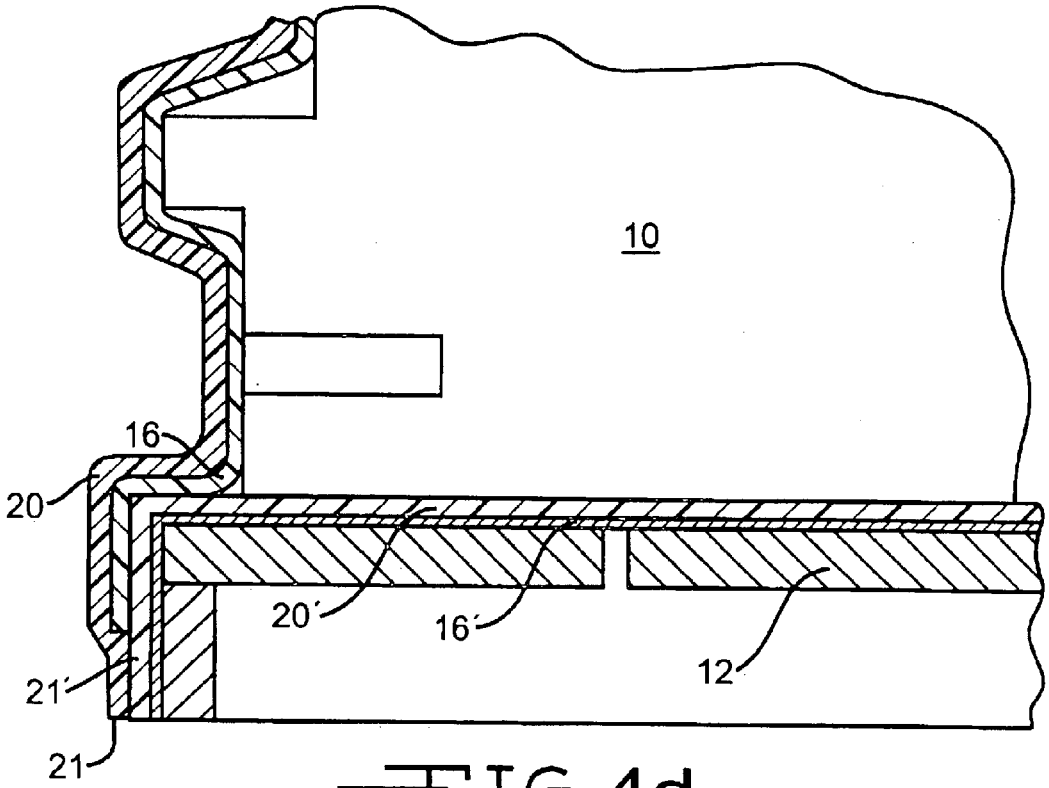

As shown in FIGS. 4*c* and 4*d*, another substrate 16 is then applied to wrap the object 10 and the side of the pallet 12, in order to create a smooth surface adapted to receive a second layer of sprayable plastic 20 thereon. Optionally, the substrate can be attached to the pallet by any suitable fastening means (not shown). Preferably, one or more depth indicators 22 are applied to the substrate 16 to facilitate spraying the second layer of plastic 20 to a desired thickness. The depth indicators 22 can be buttons, pins, posts or any other suitable depth indicating devices. The depth indicators can be applied to the object 10 instead of to the substrate. Preferably, both the substrate 16 and the second layer of plastic 20 extend over at least two sides of the pallet, and more preferably over all the sides. Preferably, the edge 17 of the substrate 16 does not extend over the edge 21' of the first layer of plastic 20', so that the edge of the first layer of plastic is left exposed. As shown in FIG. 4*d*, a second layer of the sprayable plastic 20 is sprayed onto the substrate 16, the object 10, and the pallet 12 to encapsulate the object. In the preferred embodiment shown, the edge 21 of the second layer of plastic 20 is sprayed onto the exposed edge 21' of the first layer of plastic 20' and forms a bond therewith. This creates a very strong and tight package on the object.

In one embodiment of the method, the plastic is sprayed onto the substrate and the object and allowed to cure to form a rigid skin. Then this rigid skin is bonded to the layer of plastic previously sprayed on the surface of the pallet, by any suitable method, such as with tape, adhesive or fasteners. Lastly, the sprayable plastic is sprayed onto the rigid skin and the pallet to encapsulate the object.

Any suitable sprayable plastic having the desired properties can be used in the invention. Preferably, the sprayable plastic is selected from polyurea elastomers, other isocyanate plural component systems, polyurethanes, polyamides, latex, and mixtures thereof. A particularly preferred plastic for use in the invention is a polyurea elastomer. Suitable polyurea elastomers are described in U.S. Pat. No. 5,763,734 to Nachtman et al., issued Jun. 9, 1998, and U.S. Pat. No. 5,415,499 assigned to Foamseal, Inc. (both incorporated by reference herein). The polyurea elastomer is prepared by mixing and reacting an isocyanate-terminated compound or polymer with an amine compound containing at least two reactive amine groups and then essentially immediately applying the resultant reacting mixture to the contaminated substrate. Preferably the mixing of the two reactants is effected directly with a spray gun used to apply the mixture (i.e., impingement mixing). Other preferred polyurea elastomers are described in the following patents assigned to Texaco Chemical Co.: U.S. Pat. Nos. 5,189,075, 5,124,426, 5,013,813, 4,607,090, 4,444,910, 4,433,067 and 4,379,729 (all incorporated by reference herein) These patents also disclose chain extenders which can optionally be formulations.

EXAMPLE 1

A preferred hard (stiff) version of a polyurea elastomer is a 1:1 volume mixture (index 1.05) of an isocyanate portion and an amine portion as follows:

Isocyanate Portion:

60% 4,4'-methylene diphenyl diisocyanate (MDI) (Rubinate X 9009)

40% polypropylene glycol (average molecular weight of 2000)

Amine Portion:

25% 3,5-diethyltoluene-2,4-diamine and 3,5-diethyltoluene-2,6-diamine (Ethacure 100)

32% triamine-terminated polymers (Jeffamine T-3000)

32% amine-terminated polypropylene glycol (Jeffamine D-2000)

11% 4,4'-methylene diphenyl di(N-alkyl)amine (Unilink 4200)

The isocyanate portion and amine portion are mixed and sprayed onto a contaminated substrate using the apparatus illustrated in FIGS. 1 and 2. The coating of polyurea elastomer sets very rapidly and contains or shields the contamination on the substrate.

The polyurea elastomer has the following physical properties:

| | |
|---|---|
| Elongation, % | 350 |
| Tensile Strength, psi | 2000 |
| Shore D Hardness | |
| 0 sec | 52 |
| 10 sec | 45 |
| Impact, Notched, ft-lbs/inch | 4.9 |
| Flexural Modulus, psi | |
| 158.degree. F. | 20810 |
| 77.degree. F. | 38010 |
| −20.degree. F. | 100910 |
| Spraying gel time, sec. | 2–3 |
| UV resistance | good |
| Elongation to break (adv.) | 106 mm |
| lbs. to break (adv.) | 156 |
| Chemical resistance (ASTM D 1239) Benzene | Solubility low to nil |
| Breakthrough test for benzene (elastomer did not allow transmission of benzene) | |
| Surface at 20 sec. | Dry |

EXAMPLE 2

A preferred soft (rubber-like) version of the polyurea elastomer is a 1:1 volume blend (index 1.05) of isocyanate portion and an amine portion as follows:

Isocyanate Portion:

57% 4,4'-methylene diphenyl diisocyanate (MDI) (Rubinate X 9009)

38% 4,4'-methylene diphenyl diisocyanate (MDI) (Rubinate X 9272)

5% propylene carbonate

Amine Portion:

80% amine-terminated polypropylene glycol (Jeffamine D-2000)

20% 3,5-diethyltoluene-2,4-diamine and 3,5-diethyltoluene-2,6-diamine (Ethacure 100)

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A method of packaging an object comprising the steps of:

applying a substrate to an object to create a smooth surface adapted to receive a sprayable plastic thereon; and spraying the sprayable plastic onto the substrate and the object to encapsulate the object.

2. A method according to claim 1 wherein the sprayable plastic comprises a polyurea elastomer.

3. A method according to claim 1 wherein the substrate is applied by shrink wrapping the substrate about the object.

4. A method according to claim 1 wherein the substrate substantially completely covers the object.

5. A method according to claim 1 wherein the substrate comprises a sheet material.

6. A method according to claim 5 wherein the substrate comprises a plastic sheet.

7. A method according to claim 1 wherein the object is contaminated.

8. A method according to claim 1 wherein the object has a volume of at least about 100 $ft^3$.

9. A method according to claim 1 wherein the sprayable plastic creates a water-proof encapsulation about the object.

10. A method according to claim 1 wherein the sprayable plastic is a fluid when sprayed and cures to form a rigid encapsulating skin.

11. A method according to claim 1 wherein a depth indicator is applied to the substrate or the object to facilitate spraying the plastic to a desired thickness.

12. A method of packaging an object comprising the steps of:

spraying a sprayable plastic onto a surface of a pallet to create a continuous first layer of the plastic on the surface;

positioning an object on the first layer of plastic on the pallet, the first layer of plastic having an outline that is at least as large as the outline of the object on the pallet;

applying a substrate to the object to create a smooth surface adapted to receive a second layer of the sprayable plastic thereon; and spraying the second layer of the sprayable plastic onto the substrate to encapsulate the object.

13. A method according to claim 12 further comprising a step of applying a substrate to the surface of the pallet before spraying the sprayable plastic on the surface.

14. A method according to claim 12 wherein the substrate does not extend over the edge of the first layer of plastic, so that the edge of the first layer of plastic is left exposed, and wherein the second layer of plastic is sprayed onto the exposed edge of the first layer of plastic and forms a bond therewith.

15. A method according to claim 12 wherein the substrate extends over at least two sides of the pallet.

16. A method according to claim 15 wherein the second layer of plastic extends over at least two sides of the pallet.

17. A method according to claim 12 wherein the step of spraying the sprayable plastic onto the substrate, the object, and the pallet comprises:

spraying the sprayable plastic onto the substrate and the object and allowing the sprayable plastic to cure to form a rigid skin;

bonding the rigid skin to the layer of plastic on the pallet; and spraying the sprayable plastic onto the rigid skin and the pallet to encapsulate the object.

18. A method according to claim 17 wherein the rigid skin is bonded to the layer of plastic with tape.

* * * * *